United States Patent [19]

Rogers, Jr. et al.

[11] 3,984,259

[45] Oct. 5, 1976

[54] ALUMINUM CARTRIDGE CASE

[75] Inventors: Ralph W. Rogers, Jr., New Kensington; Charles H. Deveney, Lower Burrell; Edsel W. Johnson, Gibsonia, all of Pa.

[73] Assignee: Aluminum Company of America, Pittsburgh, Pa.

[22] Filed: Aug. 22, 1975

[21] Appl. No.: 606,845

[52] U.S. Cl. ..... 148/12.7 A

[51] Int. Cl.[2] ..... C22F 1/04

[58] Field of Search ..... 148/11.5 A, 12.7 A, 148/159

[56] References Cited

UNITED STATES PATENTS

| | | | |
|---|---|---|---|
| 2,220,652 | 11/1940 | Irmann | 148/12.7 A |
| 2,736,085 | 2/1956 | Parre | 29/1.3 |
| 3,498,221 | 3/1970 | Hilton et al. | 29/1.3 |
| 3,614,816 | 10/1971 | Weyhmuller | 29/1.3 |
| 3,761,322 | 9/1973 | Winter et al. | 148/11.5 A |
| 3,765,297 | 10/1973 | Skochko et al. | 89/1 R |
| 3,791,880 | 2/1974 | Hunsicker et al. | 148/11.5 A |
| 3,802,931 | 4/1974 | Bylund | 148/11.5 A |

*Primary Examiner*—W. Stallard
*Attorney, Agent, or Firm*—A. Alexander; Carl R. Lippert

[57] ABSTRACT

An improved cartridge case is fabricated from rod or bar stock formed from a billet of an alloy containing, by weight, 5.2 to 6.2% Zn, 1.9 to 2.5% Mg, 1.2 to 1.9% Cu, 0.18 to 0.25% Cr, the remainder essentially aluminum. The method of fabrication of the cartridge case from a billet of the alloy comprises a controlled sequence of steps in forming rod or bar working stock so as to ensure against the formation of coarse recrystallized grains and the consequent forming of surface cracks or checks in subsequent metal working operations which include segmenting the rod, annealing the segmented parts and thereafter forming such segments into cartridge cases by cupping and wall ironing procedures. The mouth of the case can be annealed for ease of forming a retaining groove about a projectile positioned in the mouth of the case and in some instances for providing resistance to stress corrosion cracking.

10 Claims, 8 Drawing Figures

ALUMINUM CARTRIDGE CASE

This invention relates to aluminum cartridge cases and a method of making the same. In particular, the invention relates to a method of fabricating an improved aluminum cartridge cases from rod stock, which case has a surface free of cracks or checks and a mouth portion highly resistant to stress corrosion cracking even after being circumferentially grooved to hold a projectile therein.

BACKGROUND OF THE INVENTION

Because of the relatively light weight of aluminum when compared to brass or steel or similar materials, there is an ever increasing desire to utilize this advantage in aluminum cartridge cases provided such could be made to satisfy the severe requirements inherent in this application. The light weight is important especially in view of present day technology which allows for very rapid fire weapons which in the case of aircraft, for example, have the capability of firing in the vicinity of 6000 rounds of ordnance per minute. Because of this rapid fire, it is more advantageous for the aircraft to carry more ammunition; however, obviously, there are certain weight limitations that must be adhered to for the aircraft and thus all components are normally made as light as possible in order to carry larger payloads. For example, in considering a 30 mm cartridge case, an aluminum case is only about ⅓ the weight of a steel or brass case thus providing a large savings in payload. Or in the loaded cartridge, a complete aluminum cased round only weighs about 70% that of a steel or brass cased round. To further illustrate the importance in weight, a 30 mm aluminum cartridge case weighs about ⅓ pound and firing 6000 rounds of such would use about 1 ton of aluminum, the equivalent is steel or brass being about 3 tons. Thus, it can be seen that using aluminum cartridge cases results in large weight savings and the ability to carry many more rounds of ammunition.

When an aluminum alloy is used for cartridge cases, it is important that the alloy have high strength and toughness and tear resistance to ensure against jamming or tearing during the firing operation. Some aluminum alloys have the requiste strength, for instance, 7075 type, but can lack the needed tear resistance, whereas others have the necessary tear resistance, for instance, 2024 type, but can lack the yield strength. The absence of one or the other of these characteristics can result in failures or other shortcomings such as weight increase. Jamming failures often develop as a result of rim shear encountered because of the high stresses experienced during loading, firing and extracting. Here the rim on the head of the case which forms one side of an extractor groove shears and can interrupt or disturb and ejection operation. Rim failure appears to be characteristic of alloys having a relatively low yield strength. Failures by tearing can seriously interfere with the firing operation by allowing hot propellant gases to escape into the breech of the gun, which gases can melt the aluminum case or do damage to the steel parts of the gun. Aluminum alloy 7475 combines both high strength and tear resistance in sheet or plate material as indicated in U.S. Pat. No. 3,791,880 which issued in the name of Hunsicker and Staley in February 1974. This sheet or plate can be used in producing cartridge cases of high strength and toughness. However, because of the scrap losses generated by blanking discs from sheet or plate and also, the fabricating steps required to provide the sheet or plate, it can be more advantageous to form the cartridge cases from rod or bar stock. However, fabricating cartridge cases from slugs cut from a rod or bar stock formed from 7475 type alloy stock by conventional practices can result in undersirable circumferential surface cracks or checks and in certain instances after extended periods of storage in susceptibility to stress corrosion cracking in the region where the neck of the cartridge case is squeezed to grip the projectile. Such surface cracking or stress corrosion cracking can lead to failure in firing. It is readily appreciated that failure in firing is usually considered totally unacceptable in weapon systems and hence these problems must be overcome on a highly consistent and repeatabale basis.

This invention overcomes the problems encountered in fabricating an aluminum cartridge case from rod or bar stock by providing a controlled sequence of steps resulting in an improved cartridge case which is crack-free and not subject to stress corrosion cracking and which has high strength and toughness or tear resistance.

SUMMARY OF THE INVENTION

This invention provides an aluminum cartridge case which is crack-free, has high yield strength and tear resistance and is not susceptible to stress corrosion cracking. The improved cartridge is fabricated from a rod or bar extruded from an alloy containing 5.2 to 6.2% Zn, 1.9 to 2,5% Mg, 1.2 to 1.9% Cu, 0.18 to 0.25% Cr, the remainder essentially aluminum. In the method of fabrication of teh cartridge cases, a billet of this alloy is homogenized, worked into rod or bar stock as by extrusion at about 550° to 800°F to provide a fine or unrecystallized grain structure which can be fabricated into crack-free cartridge cases. The bar or rod is segmented into slugs or blanks which are fabricated into cartridge cases through a series of steps including preforming, cupping, drawing, ironing, and necking or tapering, with intermittent anneals employed at certain intervals to ease subsequent operations. The final cartridge case configuration is solution heat treated, quenched and artifically aged. The necked-down or mouth portion can be annealed in certain instances for ease of crimping a portion of the neck into retaining grooves in the projectile and in some instances to ensure against stress corrosion cracking at the crimped neck portion. Strength losses at the mouth portion resulting from such are not especially detrimental since strength at this location is not normally critical.

OBJECTS

An object of the present invention is to provide an aluminum cartridge case having sufficiently high tear resistance and high tensile strength to sustain its intended use.

An object of the present invention is to provide an aluminum cartridge case substantially free of surface cracks or checks.

Another object of the present invention is to provide an aluminum cartridge case sufficiently resistant to stress corrosion cracking to enable safe and dependable use after extended periods of storage. BRIEF DESCRIPTION OF THE DRAWINGS FIGS. 1 through 7 are elevation views in cross-section illustrative of the forming steps involved in making a cartridge case in accordance with the present invention.

FIG. 8 is a fragmentary elevational cross-section view showing a projectile engaged in the mouth of a cartridge case.

DETAILED DESCRIPTION OF THE PREFERRED EMBODIMENTS

Figure 1:
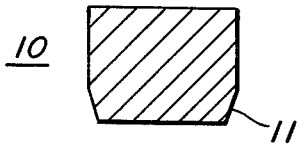

In accordance with the present invention, an aluminum base alloy is provided which, by carefully controlled thermal and fabricating practices, can be first extruded or rolled into rod or bar and thereafter formed into cartridge cases having high strength and tear resistance and which are not susceptible to damage by stress corrosion cracking. The composition of the alloy consists essentially of 5.2 to 6.2 wt. % zinc, 1.9 to 2.5 wt. % magnesium, 1.2 to 1.9 wt. % copper, 0.18 to 0.25 wt. % chromium, the remainder aluminum and incidential impurities. The impurities should be limited to not more than 0.12 wt. % Fe, 0.10 wt. % Si, 0.06 wt. % Mn, 0.06 wt. % Ti and preferably, 0.05 wt. % each of other elements and 0.15 wt. % combined other elements.

Not only is it important to utilize an aluminum alloy within the above-prescribed composition limits, but the cartridge case formed from the alloy should be prepared according to specific procedures as described herein in order to be crack-free and provided the requisite strength, tear and corrosion characteristics. The alloy of the present invention may be suitably provided in billet form by techniques currently employed in the art. These include continuously or otherwise casting an ingot and further preparing such for rolling extruding into rod such as preliminary working, scalping, and the like. However, before subjecting the alloy to the principal metal working steps, it should be subjected to homogenization at temperatures of at least 800°F and preferably between 850° to 890°F for at least 4 hours. This treatment, which is considered a homogenization, overcomes as-cast dendritic microsegregation and provides an essentially uniform microstructural distribution of the primary solute elements Zn, Mg and Cu. However, it also causes some precipitation in situ of Cr as $Al_{12}Mg_2Cr$ particles, hereinafter designated E phase particles, which have a median size of 750 A and a maximum size generally not exceeding 1000 A. After homogenization, the body is subjected to a carefully controlled high temperature treatment wherein it is heated to a temperature of at least 940°F and preferably between 950° and 1000°F. It is held at this temperature for a period generally of 6 to 48 hours. The heating rate to the high temperature preferably does not exceed 150°F per mminute. This high temperature treatment agglomerates and dissolves precipitate particles of the $Al_{12}Mg_2Cr$, E phase, which precipitate from supersaturated solid solution during the initial elevated temperature exposure treatment. During the higher temperature treatment these particles grow to a median size of 1400 A with some reaching up to 3000 A. It is in this condition that the described alloy achieves its high tear resistance to go with its high strength.

In producing cartridge cases or other cupped, drawn and ironed container-like vessels from an extruded rod, typically a segment of the extruded rod is preformed as by more or less axial compression and then cupped as by impact extrusion to produce a relatively thick-wall cup-like member which is further drawn and ironed. Because of the strength of the alloy herein described, the extruded stock should be annealed in order to facilitate the preforming and cupping operations. However, the annealing can result in the formation of a coarse recrystallized grain condition and it is such a coarse recrystallized grain condition that can lead to the formation of surface cracks or checks in the preforming and cupping operations and these defects survive subsequent operations to leave the cartridge casing defective with respect to such cracks or checks. That is, the extruded stock as produced has a suitable grain condition to avoid susceptibility to crack or check formation during subsequent operations, but the metal as extruded is too hard to be readily shaped. The annealing treatment necessary to relieve the metal hardness and faciliate subsequent forming operations is where the coarse recrystallized grain condition is formed and it is this condition which can lead to the surface cracks and checks. The cracks referred to are short circumferential cracks which can also be referred to as checks. The checks or cracks tend to form initially during the preforming and cupping operations and tend to survive subsequent metal working operations to leave the final cartridge casing with a plurality of short circumferential cracks or checks or other discontinuities which, is service, are quite unacceptable as tending to lead to rupture and tearing. Thus, the alloy described with its inherent high strength and tear resistance can be rendered failure prone when employing extruded or otherwise formed rod which is segmented, annealed, preformed, cupped and further drawn and ironed to form the casing.

The problem has its roots in the working process employed to produce the rod and it is here that the practice of the invention contemplates special care to avoid the formation of the coarse recrystallized grains in the subsequent annealing and their detrimental effect on the later preforming and cupping operations. Accordingly, the invention contemplates that the alloy after homogenization and high temperature treatment be extruded, rolled or otherwise formed into rod or bar of a size or diameter suited for the subsequent forming operations and that such working operations be conducted within a temperature range of about 550°–800°F. Working within this temperature range favors the production of rod or bar in a condition which is considerably less prone to the formation of large recrystallized grains and the attendant cracking and checking problem.

Practicing the invention employing the above-stated 550°–800°F temperature in the metal working process, typically extrusion, to initially produce the rod tends to favor the formation of transverse cracks during extrusion, and these cracks can result in rejection of the extruded stock. This cracking tendency, however, is overcome by the use of sufficiently slow extrusion rates. Hence, the invention contemplates a relatively high temperature-low speed practice which represents something of a departure from established preferences favoring somewhat lower temperatures but higher extrusion rates. Nonetheless, the herein-described rod formation temperature condition, while tending to necessitate slower working rates imparts the highly desired freedom from substantial amounts of coarse recrystallized grain formation on subsequent annealing and thus tends to avoid the formation of cracks and checks on later preforming and cupping operations. This, in turn, enables utilization of the toughness and tear resistance characteristics of the described alloy otherwise frustrated by the cracks and checks.

While the practice of the invention tends to avoid the formation of excessive amounts of coarse recrystallized grain structure after annealing some amount of such is almost unavoidable because of certain conditions inherent in the extrusion process. Typically the initial or front portion of an extruded bar is less prone to form coarse recrystallized grains whereas the latter or tail portions are somewhat more prone, expecially in the surface or peripheral portions. Thus, in practicing the invention some amount of coarse recrystallized grain condition is tolerable in the surface portions provided the thickness thereof does not exceed 0.025 inch and preferably does not exceed 0.010 inch. In some instances the coarse grain zone can be deeper than the stated 0.025 inch but the likelihood of forming crack-free cartridge cases in such instances is considerably less favorable.

Thus, the invention contemplates extrusion and rod forming conditions wherein the susceptibility to the formation, upon annealing, of coarse recrystallized grains in the surface or peripheral portions does not extend further into the rod than the stated 0.025 inch and preferably not further than 0.010 inch. This is accomplished by extruding or forming the rod at the stated temperature of 550° to 800°F which, in turn, can lead to slower working rates. Extruding at lower temperatures more favorable to higher production rates and crack-free extrusions, for instance extruding at a temperature of about 450°, leaves the rod prone on annealing to coarse recrystallized grain formation in a relatively thick band extending inwardly from the surface which, on later preforming and cupping operations, tends to lead to the circumferential cracks and checks so objectionable in producing cartridge casings.

It is also important that the extruded rod or bar not be worked further to reduce its diameter at lower temperatures than those stated since such cold work or reductions tend to favor the formation of coarse recrystallized grains throughout the cross-section of the rod on subsequent annealing operations. For instance, many typical extruding operations to produce bar or rod stock for cupping and ironing operations are followed by a cold finishing operation which contemplates drawing through a die only slightly smaller than the extruded or rolled stock so as to obtain a perfectly circular and properly controlled diameter. This common practice in the art is necessarily avoided in practicing the invention since it tends to favor the formation of coarse recrystallized grain condition after annealing operations.

As indicated earlier, the rod is segmented to provided segments or slugs suited for subsequent operations and is annealed to further facilitate these operations. It is preferred that the annealing treatment follow the segmenting operation since the rod in the harder condition is more readily segmented. Annealing treatments are preferably performed at temperatures of about 600°–875°F, preferably 675° to 800°F, for a period of about ½ to 4 hours followed by cooling relatively slowly. A cooling rate of about 50°F per hour to a temperature of around 450°F or so is suitable; after 400° or so the cooling rate is less significant.

The rod produced or described is divided into short segments or blanks 10 as shown in FIG. 1. In some instances segments 10 may have metal machined off one end to provide a tapered or beveled portion 11 which faciliates positioning the segments in dies for subsequent metal forming operations. Thereafter, the segments or blanks 10 should be annealed at a temperature of 675° to 875°F for a period of ½ to 4 hours and cooled slowly to provide further assurance against formation of the undersirable coarse grain structure. A cooling rate of 50°F per hour to a temperature of 450°F has been found quite suitable. It is preferred that the annealing be performed after the rod or bar is segmented.

Figure 2:
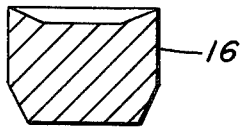

In many instances, it has been found convenient to preform segment 10 to a shallow cup configuration as shown in FIG. 2. Such preforming ensures against eccentricity occurring in the walls of the cartridge case as it is subsequently formed. The tapered portion 11 helps in this respect by aligning the segments 10 in a die aperture for the preforming operation.

In preforming, as well as providing the shallow cup, the diameter of the segment 10 is increased by virtue of the force required to provide the cup. For instance, a typical rod diameter may be about 1.8 inches and upon preforming the diameter can reach approximately 2 inches. Such increase in diameter obviously increases the extent of the circumferential wall 16. In this step of preforming, with the resultant increase in diameter and extent of wall 16, if the grain structure is in the undesirably recrystallized coarse condition, as mentioned earlier, a very rough surface on wall 16 develops. Such roughness entraps lubricant used in the subsequent forming steps and gives rise to the short circumferential surface cracks or checks. However, extruding in accordance with the present invention provides fine grain structure, or a structure which behaves like fine grain structure, e.g. unrecrystallized grain structure, and avoids this problem and provides a preformed segment with a smooth surface on the circumferential wall thereof.

Figure 3:
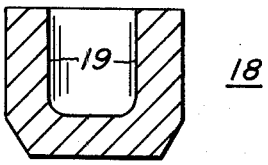
Figure 4:
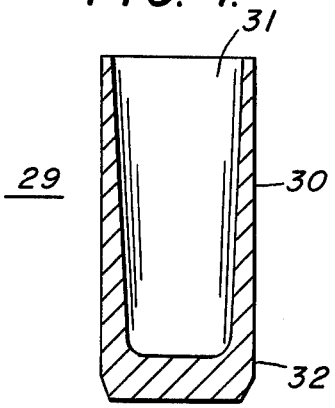
Figure 5:
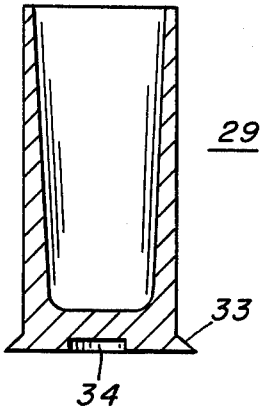
Figure 6:
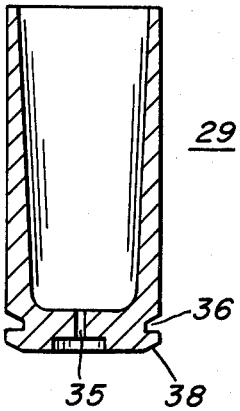

After preforming, the segment is formed into a thick walled cup 18 by impact extrusion typically at room temperature. This operation could be designated a cupping operation. The cup 18, shown schematically in FIG. 3, has a generally cylindrical wall portion 19. Cup 18 is annealed at 675° to 700°F for about ½ to 2 hours and thereafter drawn and ironed normally at room temperature through a series of steps as indicated by FIGS. 4 through 6 to provide a partially formed cartridge case 29. In FIG. 4, case 29 is shown having a wall section 30, a mouth opening 31 and a head portion 32. The wall section 30 decreases in thickness from head 32 to mouth opening 31. As well as decreasing in thickness, wall section 30 tapers or diverges inwardly from head 32 to mouth 31.

Subsequent forming steps include trimming, providing head 33 and pocket 34 (FIG. 5) vent 35 and extractor groove 36 (FIG. 6). With respect to the extractor groove 36 and particularly the rim 38 adjacent groove 36, the alloy of the present invention, particularly by following the thermal and forming steps, has sufficiently high strength and tear resistance so as not to shear or fail mechanically from stresses encountered during loading and firing and extracting the empty cartridge case.

The partially formed cartridge case as shown in FIG. 6 is provided with a neck portion 40 (FIG. 7) into which is projectile may be positioned.

Figure 7:
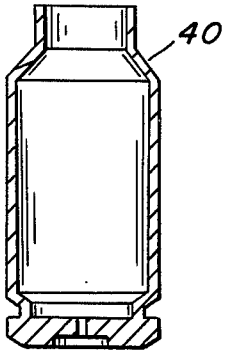
Figure 8:
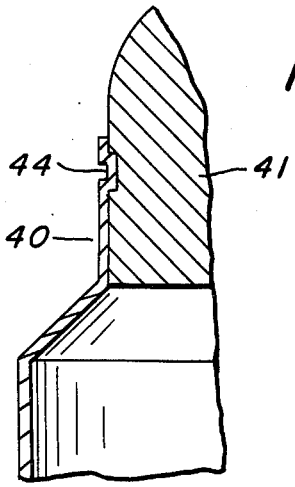

After shaping to the final configuration, for example FIG. 7, the cartridge case is solution heat treated, quenched and artificially aged. The solution heat treatment is typically at a temperature of 870° to 950°F with a range of 925° to 950°F contemplated. The time at these temperatures should be minimized with a preferred time range being about ½ to 1 hour. After solution heat treating, the case is quenched into cold water. After quenching, the cartridge case can be artificially aged to T6, T76 or T73 tempers. The T6 temper can be a thermal treatment of 24 hours at 250°F or 3 hours at 240°–250°F followed by 3 hours at 315°–325°F. The T76 temper normally is a thermal treatment of 3 hours at 250°F followed by 15 hours at 315°F. The T73 temper is a thermal treatment of 3 hours at 240°–250°F followed by 8 hours at 340°–350°F.

In order to provide a necked portion 40 which is easily crimped to provide a groove 44 to retainably engage the projectile 41 in the mouth of the cartridge case particularly if the case is in the T6 or T76 temper, it is important that the necked portion 40 be subjected to thermal treatments which can be referred to as annealing. Such thermal treatment or annealing may be achieved by exposing the neck portion 40 to a temperature of about 550° to 600°F for a period of 30 to 60 seconds, with a typical annealing temperature being 575°F and typical time period being 45 seconds. As well as for the crimping operation, it is important to adhere to the annealing times and temperatures to provide stress corrosion cracking resistance in the necked portion 40.

EXAMPLE

To further illustrate the invention, a 9-inch billet of an alloy consisting essentially of 5.7 wt. % zinc, 2.3 wt. % magnesium, 1.5 wt. % copper, 0.25 wt. % chromium, the remainder aluminum, was homogenized by heating to a temperature of 860°F for a period of 6 hours, followed by a temperature of 960°F for 24 hours and allowed to air cool. The billet was reheated to about 750°F and extruded at a rate of about 8 ft./min. to provide a rod circular in cross-section and about 1.80 inches in diameter. The rod was cut into slugs or blanks about 1.5 inches long which were annealed for 75 minutes at 740°–750°F then cooled at about 50°F/hour to 600°F and held there for about 4 hours then cooled at 50°F/hour to 450°F and thereafter air cooled. The blanks were preformed and impact extruded to a cup having a wall of substantially constant thickness, which cup was then annealed at 650°F for about 1 hour. The cup was then drawn and ironed several times with intermediate anneals to approximately the final cartridge case lenght. The partially formed, drawn and ironed case was then provided with a head and pocket, and extractor groove and vent and the mouth of the case was necked giving the cartridge case its final configuration. The case was solution heat treated at 950°F for 1 hour, quenched, and artificially aged to T6 temper. The necked portion was annealed by subjecting it to a temperature of 600°F for 30 seconds.

While for purposes of illustrating the best mode of the invention emphasis has been placed in the disclosure upon forming a cartridge case, it will be appreciated that the present invention can be used to form containers or members having portions thereof cupped, drawn and/or ironed to controlled thicknesses which members, such as wall members, may be required to withstand pressures without rupture or failure.

While the invention has been described in terms of preferred embodiments, the claims appended hereto are intended to encompass all embodiments which fall within the spirit of the invention.

Having thus described the invention and certain embodiments thereof, what is claimed is:

1. A method of fabricating an improved aluminum cartridge case comprising:

a. providing a body of aluminum alloy consisting essentially of, by weight, 5.2 to 6.2% Zn, 1.9 to 2.5% Mg, 1.2 to 1.9% Cu, 0.18 to 0.25% Cr, the balance essentially aluminum, b. homogenizing said body of subjecting it to a temperature of 800° to 890°F for a period of 4 to 12 hours, c. following said homogenizing, thermally treating said body at a temperature of 940°F to 1000°F for a period of 6 to 48 hours, d. extruding said body at a temperature of 550° to 800°F to rod or bar, e. annealing said extruded body, f. fabricating said rod or bar into cartridge cases by operations including dividing the rod or bar into segments, impact extruding said segments, thereafter drawing, ironing, and necking a portion to form to a cartridge case configuration, said operations including intermediate anneals with controlled cooling rates, and subsequently solution heat treating, quenching, and artificially aging said cartridge case.

2. The method of claim 1 wherein said homogenizing is performed at a temperature of 860°F for a period of 6 hours and said thermal treating is performed at a temperature of 960°F for a period of 24 hours.

3. The method according to claim 1 wherein said extruding rate is about 10 to 16 ft./minute.

4. The method of claim 1 wherein segments are preformed to shallow cup form prior to said impact extruding.

5. The method of claim 1 wherein said anneals are provided at a temperature of 675° to 875°F for a period of ½ to 4 hours and said cooling rates are about 50°F/hr. to a temperature of about 450°F thereafter air cooled.

6. The method of claim 1 wherein said solution heat treating is performed at a temperature of 925 to 950°F for a period of ½ to 1 hour.

7. The method according to claim 1 including annealing the necked portion of said cartridge case at a temperature of 550° to 600°F for 30 to 60 seconds.

8. In the method of producing an aluminum cartridge case wherein elongate rod stock is segmented to provide blanks which are annealed, cupped and wall ironed and necked, the improvements comprising providing working stock in an aluminum alloy cosisting essentially of, by weight, 5.2 to 6.2% Zn, 1.9 to 2.5% Mg, 1.2 to 1.9% Cu, 0.18 to 0.25% Cr, the balance essentially aluminum, and working said stock to provide said rod stock, said working being substantially carried out at metal temperatures of from 550° to 800°F and at relatively slow rates to avoid formation of cracks while avoiding cold working effects which favor formation of large recrystallized grains on annealing.

9. A method of fabricating an improved aluminum cartridge case comprising:

a. providing a body of aluminum alloy consisting essentially of 5.2–6.2% Zn, 1.9–2.5% Mg, 1.2–1.9% Cu, 0.18–0.25% Cr, the balance essentially aluminum, b. homogenizing said body at a temperature of about 800°–890°F for a period of 4 to 12 hours, c. thermally treating said body at a temperature of 940°F to 1000°F for a period of 6 to 48 hours, d. extruding said body at a temperature of 550°–800°F to rod, e. dividing said rod into segments, f. annealing said segments at a temperature of about 675°–875°F for about ½ to 2 hours and cooling said segments slowly thereafter, g. impact extruding said segments to thick walled cups, h. annealing said cups at about 675°–875°F for about ½ to 2 hours and cooling at a rate of 50°F/hr. to a temperature of about 450°F, i. drawing and ironing said cups to form a cylindrical shaped case having one end thereof closed and the other end open to provide a mouth section, j. necking a portion of said case adjacent the mouth, thereby providing a cartridge case configuration, k. solution heat treating said case at 925° to 950°F for a period of ½ to 1 hour, l. quenching, m. artificially aging said case.

10. The method of claim 9, including annealing said neck portion at a temperature of 550° to 600°F for 30 to 60 seconds.

* * * * *